US005570489A

United States Patent [19]

Lee

[11] Patent Number: 5,570,489

[45] Date of Patent: Nov. 5, 1996

[54] LIQUID EXTRACTION DEVICE FOR A VACUUM CLEANER

[76] Inventor: Ta-tang Lee, 4th Fl., No. 14, Lane 19, Pinlang Rd., Hsintien City, Taipei Hsien, Taiwan

[21] Appl. No.: 501,311

[22] Filed: Jul. 12, 1995

[51] Int. Cl.[6] ..... A47L 7/00

[52] U.S. Cl. ..... 15/353; 15/327.2; 15/339; 55/216

[58] Field of Search ..... 15/321, 353, 327.6, 15/339; 55/216

[56] References Cited

U.S. PATENT DOCUMENTS

| | | | |
|---|---|---|---|
| 2,867,231 | 1/1959 | Gerstmann | 15/353 X |
| 3,775,951 | 12/1973 | Eicholz et al. | 15/327.6 X |
| 4,055,405 | 10/1977 | Thun-Hohenstein | 15/353 X |
| 4,226,000 | 10/1980 | Tribolet | 15/353 X |
| 4,246,676 | 1/1981 | Hallsworth et al. | 15/353 |
| 4,538,971 | 9/1985 | Miller et al. | 15/327.2 X |

*Primary Examiner*—Chris K. Moore
*Attorney, Agent, or Firm*—Kirkpatrick & Lockhart LLP

[57] ABSTRACT

A liquid extraction device for a vacuum cleaner includes a base equipped with wheels, a container having an opening and a closed bottom end received on the base, a cover sealedly mounted over the opening of the container and a filter assembly fixedly attached to and below the cover. The cover has a connecting port adapted to be connected to the vacuum cleaner. The container has a sucking port adapted to be connected to a working head and a deflector neighboring the sucking port and extending toward the bottom end of the container. A float is mounted on the filter assembly whereby when liquid in the container has reached a predetermined level, the float will be lifted to block the connecting port of the cover.

7 Claims, 3 Drawing Sheets

LIQUID EXTRACTION DEVICE FOR A VACUUM CLEANER

BACKGROUND OF THE INVENTION

Conventional dry air vacuum cleaners are a very useful appliance for housekeeping to remove dirt or rubbish on a possible surface, for example, a floor, desk top or carpet. However, due to their structural limitation, conventional air vacuum cleaners cannot be used to extract liquid as liquid will possibly enter a motor chamber in the vacuum cleaner and cause damage to a motor therein. Such a limitation greatly lower the working abilities of the conventional dry air vacuum cleaners. In view of such a limitation, some vacuum cleaner manufacturers have developed vacuum cleaners which can have dual functions: dry suction and liquid extraction. Such dual functional vacuum cleaners have a totally different design from the conventional dry air vacuum cleaners: they must suitably separate the motor chamber from the dust collection chamber, arrange the two chambers in two different levels, and so on. Such a totally new design can indeed achieve the intended function to enable a vacuum cleaner to extract liquid; however, it must have a complicated structure which results in a somewhat unbearable high cost. Additionally, to buy a dual functional vacuum cleaner causes a waste for those who already have a dry air vacuum clear, since then their dry air vacuum cleaners become superfluous.

SUMMARY OF THE INVENTION

It is an objective of the present invention to provide a liquid extraction device which can easily cooperate with a conventional dry air vacuum cleaner to enable the conventional vacuum cleaner to extract liquid.

A further objective of the present invention is to provide a liquid extraction device for a vacuum cleaner in which the liquid extraction device has a relatively simple structure and low cost.

It is a further objective of the present invention to provide a liquid extraction device which has a mechanism able to stop the extraction when liquid in the present device has been accumulated to reach a predetermined level.

It is yet a further objective of the present invention to provide a liquid extraction device which has a mechanism able to indicate the situation when liquid in the present device has been accumulated to reach a predetermined level Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
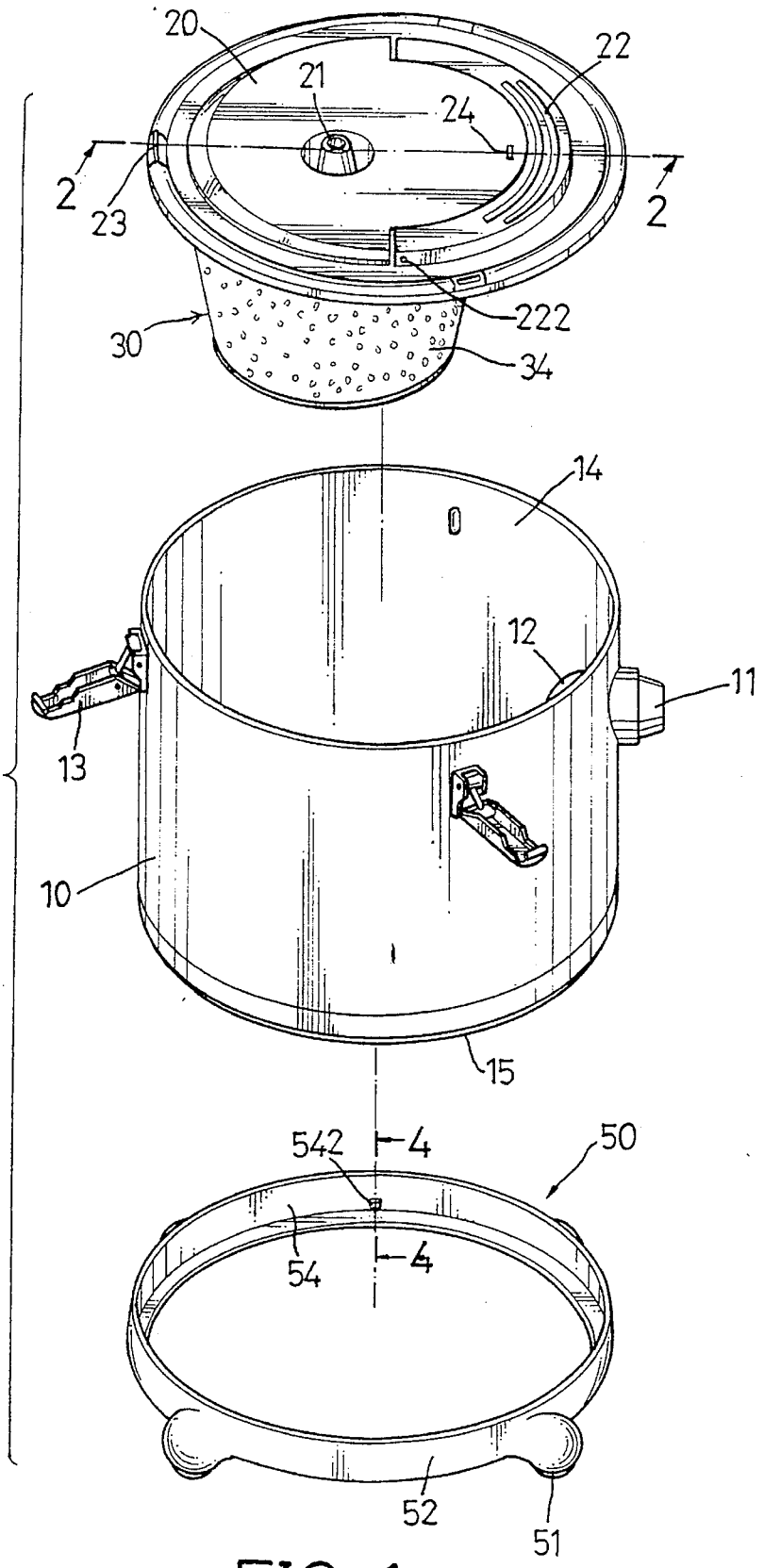
FIG. 1 is a front-right-top perspective and exploded view of a liquid extraction device in accordance with the present invention showing the parts constituting the present device.
Figure 2:
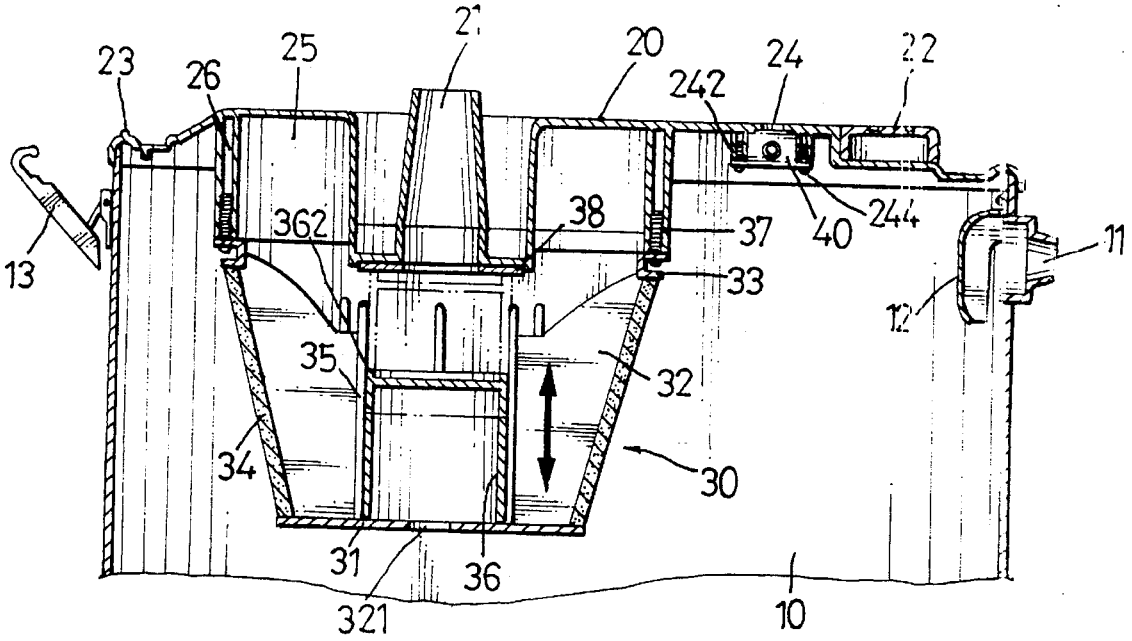
FIG. 2 is a cross-sectional view generally taken from line 2—2 of FIG. 1 showing the details of the upper portion of the present device after it has been assembled.

Referring to FIGS. 1 and 2, the present liquid extraction device is generally consisted of a cover 20, a filter assembly 30, a container 10 and a base 50. The cover 20 generally includes a connecting port 21 for connection with a conventional dry air vacuum cleaner (not shown) via a hose (not shown), a window 24 for viewing of an indicating mechanism which will be discussed in detail by referring to FIG. 3, a handle 22 pivotably mounted on the cover 20 by pins 222 (only one can be seen in the drawing) to facilitate a gripping of the present device by hand, a plurality (three as shown in FIG. 1) of ridges 23 formed on an outer edge of the cover 20 and used to cooperate with corresponding hooks 13 in a peripheral circumference of the container 10 to fixedly connect the cover 20 and the container 10 together, and an annular seal 38 (FIG. 2) fixedly attached on a bottom face of the cover 20 and located just below the connecting port 21.

The filter assembly 30 is configurated generally like a truncated cone and has a filtering element 34 provided around its peripheral circumference.

The container 10 has an opening 14 to receive the cover 20 and the filter assembly 30 and a closed bottom end 15 for receiving liquid extracted into the present device. On a right side as shown by FIG. 1, the container 10 further has a sucking port 11 for connection with a hose assembly (not shown) with a head (not shown) specifically designed to meet different working conditions of cleaning and a deflector 12 (better seen in FIG. 2) for directing the air flow flowing into the container 10 with a downward direction. As mentioned above, the container 10 has three hooks 13 for connecting the container 10 and the cover 20 together.

The base 50 (also referring to FIG. 4) has an annular configuration with an outer wall portion 52, an inner wall portion 54 connected with the outer wall portion 52 at a top end 56, and a horizontal seat portion 58 extending from the inner wall portion 54 toward a center of the base 50. The outer wall portion 52 has an arcuated profile and the inner wall portion 54 has a vertical profile, relative to the horizontal seat portion 58. The inner diameter of the inner wall portion 54 is substantially the same as the outer diameter of the lower portion of the container 10 to receive the container 10 seated on the horizontal seat portion 58. The base 50 further includes four wheels 51 to enhance the mobility of the present device.

FIG. 2 shows the details of upper portion of the present device wherein the cover 20 is connected with the filter assembly 30 and fitted over the container 10. The filter assembly 30 includes a frame member formed by a central cylinder 35 and a plurality of ribs 32 radially extending therefrom, a bottom plate 31 with a central hole 321 fixedly mounted on a bottom of the frame member, a filter member 34 fixedly mounted around a peripheral circumference of the frame member and sealedly connected over the bottom plate 31, a connecting member 33 fixedly mounted around a top portion of the peripheral circumference of the frame member and sealedly connected over the filter member 34, and a float 36 configurated to have a generally inverted-U section sealedly and slideably received within the cylinder 35.

The cover 20 has an integrally formed wall portion 25 defining six threaded holes 26 (better seen in FIG. 3) whereby the filter assembly 30 can be fixedly and sealedly connected to the cover 20 by six screws 37 passing through the connecting member 33 and threadedly engaged with the threaded holes 26.

Aside and below the window 24, the cover 20 is integrally formed with two posts 242 respectively defining threaded holes for mounting of an indicating mechanism. The indicating mechanism (also referring to FIG. 3) includes a housing 40 fixedly mounted on the bottom of the cover 20 via two screws 244 passing through two ears 44 of the housing 40 and fixedly engaged with the post 242 of the cover 20. A spring 42 and an indicator 41 are mounted within the hosing wherein the spring 42 exerts a predetermined force on the indicator 41. The indicator 41 is slideable within the housing 40. The housing 40 is communicated with the connecting port 21 via a tube 43 communicating with a side opening 212 of the port 21.

Figure 4:
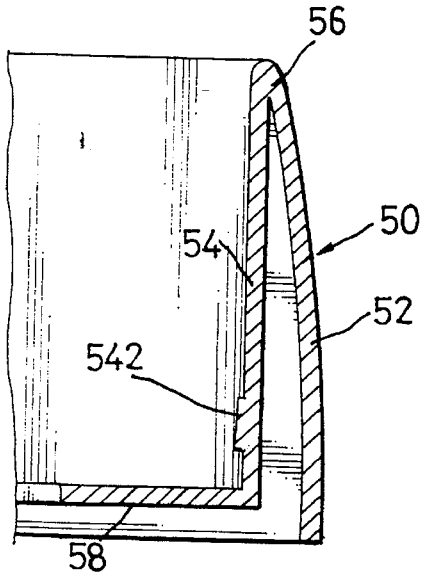
FIG. 4 is a partly cross-sectional view taken from line 4—4 of FIG. 1, in an enlarged scale, showing the details of a small protrusion on a base of the present device.

Finally, referring to FIG. 4, the inner wall portion 54 of the base 50 has a plurality (preferably four equally spaced with each other) of small protrusions 542 formed on an inner peripheral circumference thereof whereby the container 10 must have a push fit with the base 50 when the container 10 is intended to be received on the base 50 so that a fixed engagement between the base 50 and the container 10 can be obtained. When the container 10 is intended to be separated from the base 50, a user of the present device only needs to exert a pulling force on the container 10 in relative to the base 50 to pull the container 10 out of the base 50.

In operation

When the present device is used to cooperate with a conventional vacuum cleaner for working on a surface containing liquid, firstly, the connecting port 21 is connected to a sucking inlet of the vacuum cleaner via a hose, and the sucking port 11 of the present device is connected with a hose assembly with a specifically designed working head. Then, the power of the vacuum cleaner is turned on. At this moment, a flow of air is generated to flow from the sucking port 11, the deflector 12, the filter member 34, the space between the connecting port 21 and the cylinder 35, the connecting port 21 to reach the vacuum cleaner. By the air flow, the dirt or rubbish with possible liquid on the working surface is sucked into the container 10 of the present device through the sucking port 11. Due to the presence of the deflector 12 (particular referring to FIG. 2), the flow of air introduced into the container 10 via the sucking port 11 is immediately turned to a downward direction toward the bottom end 15 (FIG. 1) of the container 10. Here, due to the relatively heavy weight of liquid, when the liquid is introduced into the container 10 with the air flow and deflected by the deflector 12, the liquid will be naturally retained on the bottom end 15 of the container 10, and the dirt or rubbish which has a relatively light weight will flow with the air flow and be stopped by the filter member 34. Thus, no liquid will be sucked into the motor chamber in the vacuum cleaner.

Figure 3:
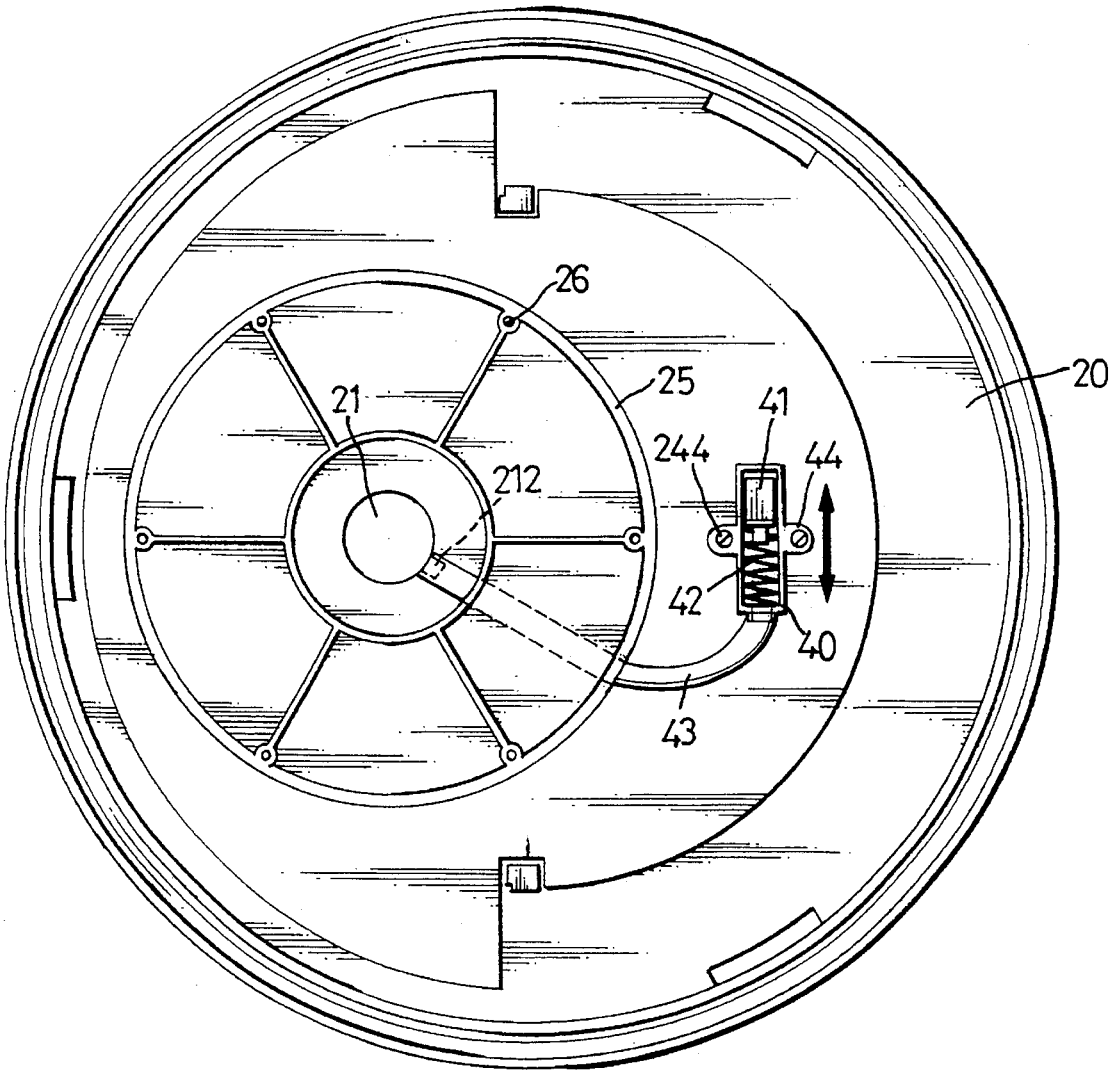
FIG. 3 is a bottom view of a cover of the present device, showing the details of a mechanism used to indicate when liquid in the present device has been accumulated to reach a predetermined level.

After a period of use, when the liquid in the container 10 has accumulated to a certain quantity, and, thus, the level thereof has reached a certain height, the liquid will flow into the cylinder 35 through the hole 321 in the bottom plate 31 whereby the float 36 begins to be lifted toward the connecting port 21. When the level of the liquid reaches a predetermined height an upper end 362 of the float 36 will reach a position (as indicated by the phantom lines of FIG. 2) engaging with the seal 38 located just below the connecting port 21 thereby to block the connecting port 21; thus, the path of the air flow generated by the vacuum cleaner is interrupted and no air flow is longer permitted to be sucked into the container 10. At this moment, a sufficiently large negative pressure which can overcome the predetermined force of the spring 42 acting on the indicator 41 is generated on the indicator 41 via the connecting port 21, the side connecting port 212, the tube 43 and the housing 40 of the indicating mechanism so that the indicator 41 is forced to move downward from the normal position as shown in FIG. 3 to a position indicating that the container 10 is filled with liquid. The change of position of the indicator 41 can be viewed from the window 24 on the top face of the cover 20. When this happens, the user must stop the operation of the vacuum cleaner and pour the liquid out of the container 10.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A liquid extraction device for a vacuum cleaner, comprising:

a container comprising an opening, a closed bottom end, a first port adapted to be connected to a hose assembly with a working head and a deflector neighboring the first port and extending toward the bottom end of the container;

a cover sealedly mounted over the opening of the container and comprising a second port adapted to be connected to a vacuum cleaner;

fastening means for fixedly connecting the container and the cover together;

a filter assembly positioned within the container and fixedly attached to and below the cover, said filter assembly comprising a frame formed by a central cylinder located just below the second port and spaced therefrom a distance and a plurality of ribs radially extending from the cylinder, a bottom plate with a central hole fixedly mounted on a bottom of the frame, a filter fixedly mounted around a peripheral circumference defined by the ribs of the frame and sealedly connected over the bottom plate, and a top connecting member mounted around a top portion of the peripheral circumference defined by the ribs of the frame and sealedly connected between the filter and the cover, and a float sealedly and slidably mounted in the cylinder;

whereby when the vacuum cleaner is turned on, a sucking air flow is generated to flow from the first port, the deflector, the filter assembly, and the second port to enter into the vacuum cleaner, and the liquid contained in the air flow, due to its relatively heavy weight, is retained on the bottom end of the container, when the liquid retained on the bottom end of the container has reached a predetermined level, the float will be floated to block the second port so that the sucking air flow is interrupted.

2. A liquid extraction device according to claim 1, wherein the filter assembly is mounted on the cover by screws passing the connecting member and threadedly engaged with threaded holes defined in the cover.

3. A liquid extraction device according to claim 1, wherein the fastening means comprises three hooks located on the container and three corresponding ridges on the cover.

4. A liquid extraction device according to claim 1 further comprising a base with wheels to receive the container thereon.

5. A liquid extraction device according to claim 4 wherein the base has a substantially annular construction with protrusions formed on an inner peripheral circumference of an annular wall of the base thereby to generate a push fit with the container when the container is received on the base.

6. A liquid extraction device according to claim 1 further comprising an indicating means for indicating that the liquid in the container has reached the predetermined level.

7. A liquid extraction device according to claim 6, wherein the indicating means comprising a transparent window on the cover, a housing fixedly mounted on the cover and located below the window, an indicator mounted within the housing and movable between a first and second position, a spring mounted within the housing and exerting a force on the indicator to push it toward the first position, and a passage communicating the housing and the second port; whereby, when the second port is blocked by the float, a sufficient negative pressure is generated on the indicator to overcome the force of spring acting thereon so that the indicator moves to the second position indicating that the liquid in the container has reached the predetermined level.

* * * * *